United States Patent [19]

Barry

[11] Patent Number: 4,716,611

[45] Date of Patent: Jan. 5, 1988

[54] APPARATUS FOR CLEANING PIPES, TUBES, AND THE LIKE BY LAUNCHING PIGS

[75] Inventor: Peter L. Barry, Narre Warren, Australia

[73] Assignee: Lacress Nominees Pty., Ltd., Camberwell, Australia

[21] Appl. No.: 785,089

[22] Filed: Oct. 4, 1985

Related U.S. Application Data

[63] Continuation of Ser. No. 527,269, Aug. 29, 1983, abandoned.

[30] Foreign Application Priority Data

Mar. 11, 1983 [AU] Australia ..... 12422/83

[51] Int. Cl.[4] ..... B08B 9/04

[52] U.S. Cl. ..... 15/3.51; 15/3.5; 15/104.062; 134/1; 134/8; 134/22.12; 134/167 C

[58] Field of Search ..... 15/3.5, 3.51, 104.05, 15/104.06 R, 104.06 A, 104.07; 134/1, 8, 22.11, 22.12, 24, 166 R, 184, 167 C, 168 C

[56] References Cited

U.S. PATENT DOCUMENTS

| | | | |
|---|---|---|---|
| 1,886,419 | 11/1932 | Oberhuber | 15/104.06 R |
| 2,745,231 | 5/1956 | Prince | 15/104.06 R |
| 2,874,078 | 2/1959 | Reinhart | 15/3.5 |
| 3,216,858 | 11/1965 | Bogdanowski | 134/22.11 |
| 3,228,611 | 1/1966 | Russell | 15/3.5 |
| 3,446,666 | 5/1969 | Bodine | 15/104.05 |
| 3,531,813 | 10/1970 | Hurst | 15/104.06 A |
| 3,900,912 | 8/1975 | Lenz et al. | 15/104.06 R |
| 4,269,264 | 5/1981 | Goeldner | 15/3.5 |
| 4,353,414 | 10/1982 | Leitner | 15/104.06 A |

*Primary Examiner*—Richard V. Fisher
*Assistant Examiner*—W. Gary Jones
*Attorney, Agent, or Firm*—Robert F. O'Connell

[57] ABSTRACT

Pipes, tubes and the like, for example, in heat exchangers, can be cleaned internally using sonic energy, a relatively incompressible pig and a flushing liquid.

The flushing liquid is supplied via a pressure outlet from a quick operating valve to one or more launchers for launching pigs. The launchers are mounted on either an x-y frame movable support or a rotary axis adapter and radially movable support for positioning the launchers with respect to the ends of the tubes to be cleaned.

4 Claims, 12 Drawing Figures

APPARATUS FOR CLEANING PIPES, TUBES, AND THE LIKE BY LAUNCHING PIGS

This is a continuation of application Ser. No. 527,269, filed Aug. 29, 1983 and now abandoned.

FIELD OF THE INVENTION

This invention relates to a method of cleaning pipes, tubes and the like, and apparatus suitable for use in such a method.

BACKGROUND OF THE INVENTION

In the chemical and oil industry one of the most persistent problems relates to the cleaning of the various connecting pipes and tubes, for example, the tubes in cooling systems, heat-recovery exchangers and condensers. (The word "tube" or "tubes" will be used hereinafter, as appropriate.)

The process may be exemplified by the production of styrene monomer. Various types of polymers and copolymers are deposited in the heat-recovery exchangers and in the condensers. The fouling caused by the deposit of such polymers decreases the overall efficiency of the systems involved. It is, therefore, necessary to clean the systems internally. One method of cleaning which has been used involves the use of high pressure water. This method is inefficient and in many cases cannot remove completely the build-up of solids on the walls of the tubes. Thus with one conventional cleaning head long gouges are cut in the solids of the walls. Furthermore, the method is very time consuming and expensive. It is also dangerous to use because of the very high pressure water streams involved and is becoming more dangerous as the pressures used increase.

Another method involves drilling out the tube. Again, this method is very time consuming and expensive. Furthermore, the drill can often become embedded in the material to be drilled. Again, when very hard polymers are encountered, the drill bit may be deflected and drill through the tube wall. If this occurs, the tube has to be either removed or plugged in place thus decreasing the efficiency of the exchanger. Even if these problems are not encountered, drilling does not completely remove material deposited on the tube walls. Generally speaking any mechanical cutting, drilling, gouging and the like method tends to score the surface of the tube leaving a region in or on which deposits can build up. The tube is damaged and weakened and its useful life shortened.

Other methods include cleaning using chemical solvents. However, this method can only be used if there is a flow pathway remaining. In addition there is a trend away from chemical cleaning methods because of the disposal problem in relation to the used solvent.

Yet another method is to burn out a deposit. However, it may be necessary to remove a particular piece of apparatus from the site so that this procedure can be carried out.

Typically, it is necessary to use a combination of methods, such as a combination of the water blast and drilling methods. Even so, such a combination may succeed only in obtaining an increase in efficiency of the cleaned apparatus of up to 90%.

It is known in the art of extracting and distributing petroleum to pass a "pig" of solid material through a pipeline to wipe deposited paraffins from the wall. Furthermore "pigging" is a known technique in the cleaning of tubes. However the pigs used are flexible and compressible and are often provided with abrasives embedded in their outer walls or with cutting or gouging devices projecting through their outer surface. Such a pig is forced through a tube by hydraulic action mechanically gouging material from the wall of the tube and pushing debris in front of it. The problem here is that the surface of the tube can also be scored, gouged and weakened.

It is an object of the present invention to overcome the problems outlined above, that is, to provide a simple, relatively inexpensive, less dangerous and more efficient method of cleaning tubes.

SUMMARY OF THE INVENTION

This invention is based upon the observation that, when a practically instantaneous hydrostatic pressure was applied to a relatively incompressible pig positioned in the outlet of such a tube, a sonic wave or waves was or were produced. The combination of the energy in the initial sonic wave or waves and the kinetic energy transmitted through the incompressible column of water behind the pig and the fine, high velocity, annular jet of water ejected forwardly of the pig produces a cleaning, even polishing, effect on the wall of the tube. The insides of the tubes were cleaned to a very considerable degree, in some cases over 95% and up to 99% of deposits were removed, including even rust and mill scale.

It is believed that, where polymeric or copolymeric deposits are involved, the initial sonic wave and the kinetic energy transmitted subsequently tend to degrade the polymeric structure and perhaps also breakdown any bonding between this structure and the metallic surface; see "Styrene—Its Polymers, Copolymers and Derivatives" eds. Ray H. Boundy and Raymond F. Boyer, Reinhold, N.Y., 1952.

This invention, therefore, relates to a method of cleaning tubes which comprises applying sonic energy to a tube locus to be cleaned and, at the same time or subsequently, removing deposits in or on said locus and flushing such deposits from said tube.

Preferably the method according to the invention comprises applying practically instantaneously a liquid at high pressure to a suitably dimensioned, relatively incompressible pig located in said tube thus producing a wave or waves of sonic energy.

For preference the liquid used is water but other relatively inexpensive flushing liquids could be used.

Suitably the pressures used are in the range from 4,000 to 10,000 psi, preferably from 4,000 to 6,000 psi. The pressure used will depend on the particular application, for example, so-called fin-fan tubes are of relatively thin wall thickness but boiler tubes are of relatives heavier wall thickness. Furthermore, larger diameter tubes (all other things being equal) have lower burst strengths than smaller diameter tubes.

Desirably the pig is dimensioned to:

travel in said tube propelled by said liquid; and provide a high velocity, annular jet of liquid ejected forwardly of said pig relative to its direction of travel in said tube.

This jet serves the dual purpose of lubricating the travel of the pig and breaking up the deposits (and even polishing the tube). The pig can be shaped to promote the formation of these jets, for example, its trailing end may be slightly chamfered.

The pig may be made of any suitable relatively incompressible material such as a suitable metal, ceramic material, composite material or plastics material, in particular a stiff, strong plastics material of the type used to replace die cast parts in gears, bearings and housings and which has good resistance to solvents. A suitable plastics material has been found to be "Delrin". This material is dimensionally stable under the conditions of use.

It is possible to machine such a pig to fit closely the particular dimensions of a tube to be cleaned. This feature is subject, of course, to a limitation in that the pig may not move at all, if there is too small a clearance. For example, clearances of between 0.01 and 0.005 mm, desirably 0.0085 mm, have been found suitable with a Delrin pig used to clean a steel tube.

In known pigging techniques rather complex pigs have been used, having abrasive material incorporated therein as described above. One advantage of the present method is that a simple pig may be used, for example, a simple cylinder of plastics material or a ball (where U-tubes are to be cleaned).

For preference, in the method according to the invention kinetic energy is transmitted subsequently to the initial sonic wave or waves to said tube locus in order to further breakdown the deposits.

For example, said liquid is applied at high pressure by means of a snap-on valve connected in line with a high pressure pump.

The practically instantaneous increase in hydrostatic pressure is produced by, for example, attaching a suitable nozzle to the inlet of a tube into which a pig has been inserted. A powerful water pump is attached to the nozzle and the water pressure applied to the pig by way of, for example, a foot operated valve such as an air-operated instant release valve.

A suitable pump is, for example, a triplex high pressure pump which delivers up to 6,000 strokes per minute. With each stroke it is believed that a pressure wave is transmitted through the incompressible column of water, the kinetic energy of the pistons being transmitted to the pig and to the deposits. These waves contribute to further breaking down of the internal structure of the deposits and their mode of attachment to the tubes.

It is believed that by far the largest proportion of the energy delivered by such a pump is expended on breaking down the deposits and in forcing the pig through the tubes rather than on the walls of such tubes.

Thus in one embodiment this invention comprises the steps of:

inserting in one end of a tube to be cleaned a relatively incompressible pig suitably dimensioned to travel in said tube;

applying a practically instantaneous hydrostatic pressure by means of a liquid to said pig in such a manner that a sonic wave or waves are produced affecting deposits in said tube;

subsequently transmitting energy to said deposits;

said pig travelling in said tube and said liquid being ejected forwardly of said pig acting to flush said deposits from said tube.

The method according to the invention may be used to clean a bank of tubes, for example, in a heat-exchanger, wherein pigs are inserted in the ends of said tubes and said practically instantaneous hydrostatic pressure is applied:

sequentially to each tube;

simultaneously to a selected number of said tubes; or simultaneously to the entire bank of said tubes.

This embodiment of the invention allows greater efficiency in the cleaning of large numbers of tubes. For example, the pump may be connected to a pressure manifold to which a number of pressure outlets are connected. These outlets are each provided with suitable valve means leading to a launcher. The apparatus may be mounted on a suitable frame to allow movement vertically and horizontally so that one or more tubes in said bank may be cleaned sequentially or simultaneously.

This invention also provides a launcher for use in the method according to the invention. At the other end of the tube a so-called catcher can be attached, leading into a cage to hold used pigs. The function of the launcher is to apply the hydrostatic pressure to the trailing end of the pig.

Thus, this invention provides a launcher for use in a method according to the invention which comprises a high pressure connecting means and a launcher tip, which launcher tip has a frusto-conical nozzle section adapted to engage sealingly the end of a tube to be cleaned.

This invention also provides an apparatus for use in a method according to the invention which comprises in combination a source of high pressure liquid, quick-operating valve means and one or more launchers as defined above.

Location and support means are also provided for use in a method according to the invention which means comprises an X-Y frame adapted to maintain one or more launchers according to the invention in position with respect to the ends or ends of a selected tube or tubes to be cleaned whereby said tube or tubes may be cleaned sequentially or simultaneously. Preferably, said X-Y frame comprises vertical support beams and horizontal support beams in combination with movable support means for one or more launchers, which movable support means is adapted to maintain said launcher or launchers in position and to resist back pressure when said launcher or launchers are used according to the invention.

An alternative embodiment of said location and support means comprises a rotary axis adaptor adapted to maintain one or more launchers according to the invention in position with respect to the end or ends of a selected tube or tubes to be cleaned whereby said tube or tubes may be cleaned sequentially or simultaneously.

Preferably, said rotary axis adaptor comprises a radial support beam or beams in combination with an axial support means and radially-movable support means, which axial support means is adapted for attachment to a bundle of tubes to be cleaned and which radially-movable support means is adapted to maintain said launcher or launchers in position and to resist back pressure when said launcher or launchers are used according to the invention.

In another aspect of this invention, sonic energy is applied to the outside of a tube by means of a known ultrasonic device. This device energy at least partially breaks down the gummy or hard deposits within the tube. This material can then be removed either by use of high pressure water by itself or by use of a pig and water.

This invention will now be explained by reference to specific applications.

APPLICATION 1

Fin Fan Exchangers

The high efficiency of fin fan exchangers, in certain applications, has increased their popularity and utilization. However their size and location make the exchangers extremely difficult to clean.

Due to the common header design, most fin fan exchangers are chemically cleaned whenever possible. In many cases, however, there is complete blockage of tubes and a water blaster or an air drill must be used. Both of these methods are severely hampered by the length and location of most fin fan exchangers. Although these methods are only marginally effective, they are expensive in terms of time and money.

The process according to the invention can be used for fin fan exchanger cleaning because a smaller working space is necessary. In addition it is more efficient than prior art methods.

In one example a drilling method was used in an attempt to clean a bank of fin fan exchangers. An acceptable standard of 75% operating capacity was achieved, that is, 25% of the tubes remained blocked. Using the method according to the invention approximately 99% efficiency was obtained. Furthermore, the overall shut-down period was reduced considerably.

APPLICATION 2

U-Tube Heat Exchangers

Although U-tube heat exchangers have advantages in efficiency they are often the most troublesome of all exchangers due to fouling. Fouling is a severe problem because the U-portion of the exchanger is so difficult to clean.

If there is a possibility than any of the tubes in the bundle are completely plugged, chemical cleaning is not an option. Water blasting is usually the most effective way to clean a U-tube exchanger. This process works fairly well on some broad radius bends, but not on narrow radius bends. At best a narrow radius bend can be partially cleaned only by this process.

Cleaning according to the invention is the only effective way to thoroughly clean a plugged U-tube exchanger. It will completely remove the entire deposit from each tube regardless of the radius of the bend or the consistency of the deposit.

APPLICATION 3

Straight Tube Heat Exchangers

The most common of all heat exchangers is the straight tube and shell exchanger. Regardless of what substance moves through the exchanger tubes, some degree of fouling will eventually occur. The fouling will vary from soft deposits to complete solid plugging.

The method of cleaning used on straight tube exchangers varies according to the type and consistency of the deposit. Slightly fouled tubes can generally be cleaned by water blasting or chemical cleaning. Hard, solid tube plugging is usually cleaned by water blasting, drilling or removing the exchanger and burning out the deposit. While all of these methods work, none of them work well, and they all can be prohibitively expensive.

Cleaning according to the invention will remove all deposits easily, whether hard or soft. There is no need to use different methods for different tube bundles.

APPLICATION 4

Double Pipe Exchangers

Double pipe heat exchangers are the simplest of all heat exchanger designs. Instead of becoming completely fouled, this exchanger frequently develops a thin laminar deposit that prevents effective heat transfer.

Chemical cleaning is usually ruled out since most of the deposits cannot be readily dissolved. There is also a possibility that a trace of residue from the cleaning solution could contaminate a future product stream. In addition, the hardness of the deposit often precludes water blasting. If the exchanger is a continuous U-tube design, a water blast hose cannot make the turns and cannot be used. Often, this U-tube type exchanger must be removed from the plant and sent to an exchanger repair company to be burned out.

The process according to the invention can be used to deal with even the hardest laminar deposits. It has been used to clean continuous U-tube double pipe exchangers without removing the unit, thus saving considerable time and money.

DESCRIPTION OF A PREFERRED EMBODIMENT

Figure 1:
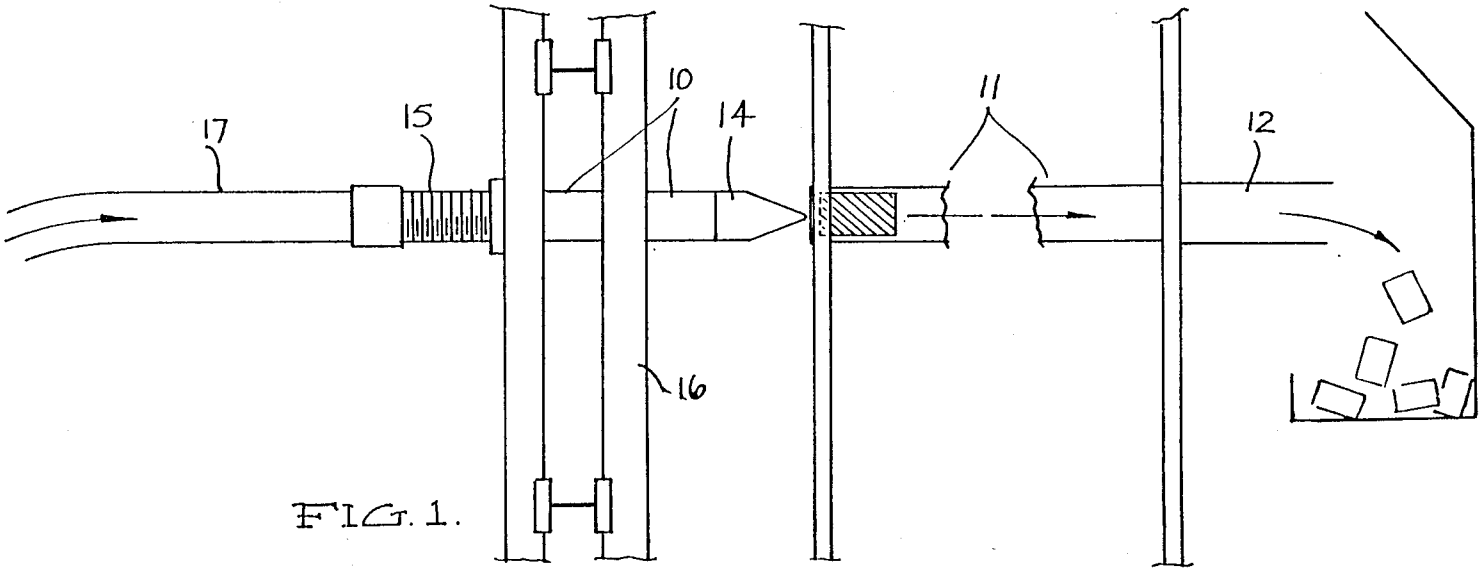
FIG. 1 shows in cross-section an embodiment of the invention as applied to a heat exchanger tube.

In FIG. 1, numeral 10 indicates a launcher adjacent one end of a heat exchanger tube 11, connected to a catcher 12 leading to a cage 13. Launcher 10 is provided at one end with a thread 15 and, at the other end shown as abutting against the end of heat exchanger tube remote from the catcher, a frusto-conical launcher tip 14. Launcher 10 engages support 16 by means of thread 15. Flexible connector 17 connects the apparatus to a source of high pressure liquid.

Figure 1E:
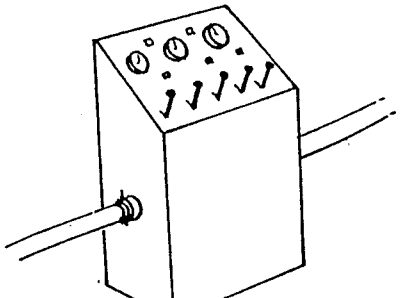
FIGS. 1*d* and 1*e* are perspective views of suitable valve means used according to the invention.
Figure 1D:
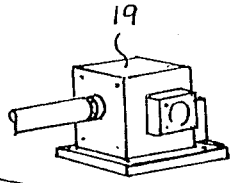
Figure 1D:
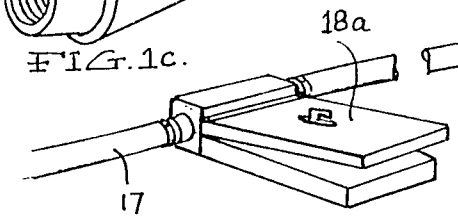
Figure 1C:
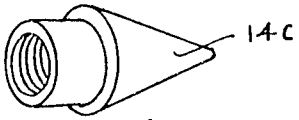
FIGS. 1*a*, 1*b* and 1*c* are perspective views from one side of three embodiments of launcher tip according to the invention.
Figure 1A:
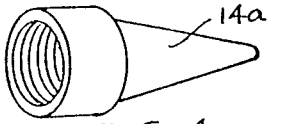
Figure 1B:
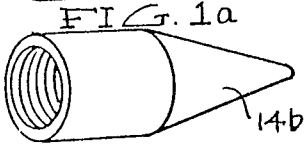

In FIGS. 1*a*, 1*b* and 1*c*, launcher tips 14*a*, 14*b*, and 14*c* (not shown in proportion) are shown. 14*a* can be used for a relatively small diameter tube 11, 14*b* for an average diameter tube and 14*c* for a larger diameter tube.

In FIG. 1*d*, flexible connector 17 connects to a foot-operated valve 18*a* leading to a high pressure pump 19. In FIG. 1*e*, an alternative type of valve means 18*b*. This valve means is air-operated and allows very rapid opening and closing of the line connecting the high pressure pump 19 to launcher 10. One flexible connector 17 is shown but this alternative allows connection of more than connector 17 to more than one launcher 10.

Figures 2, 3:
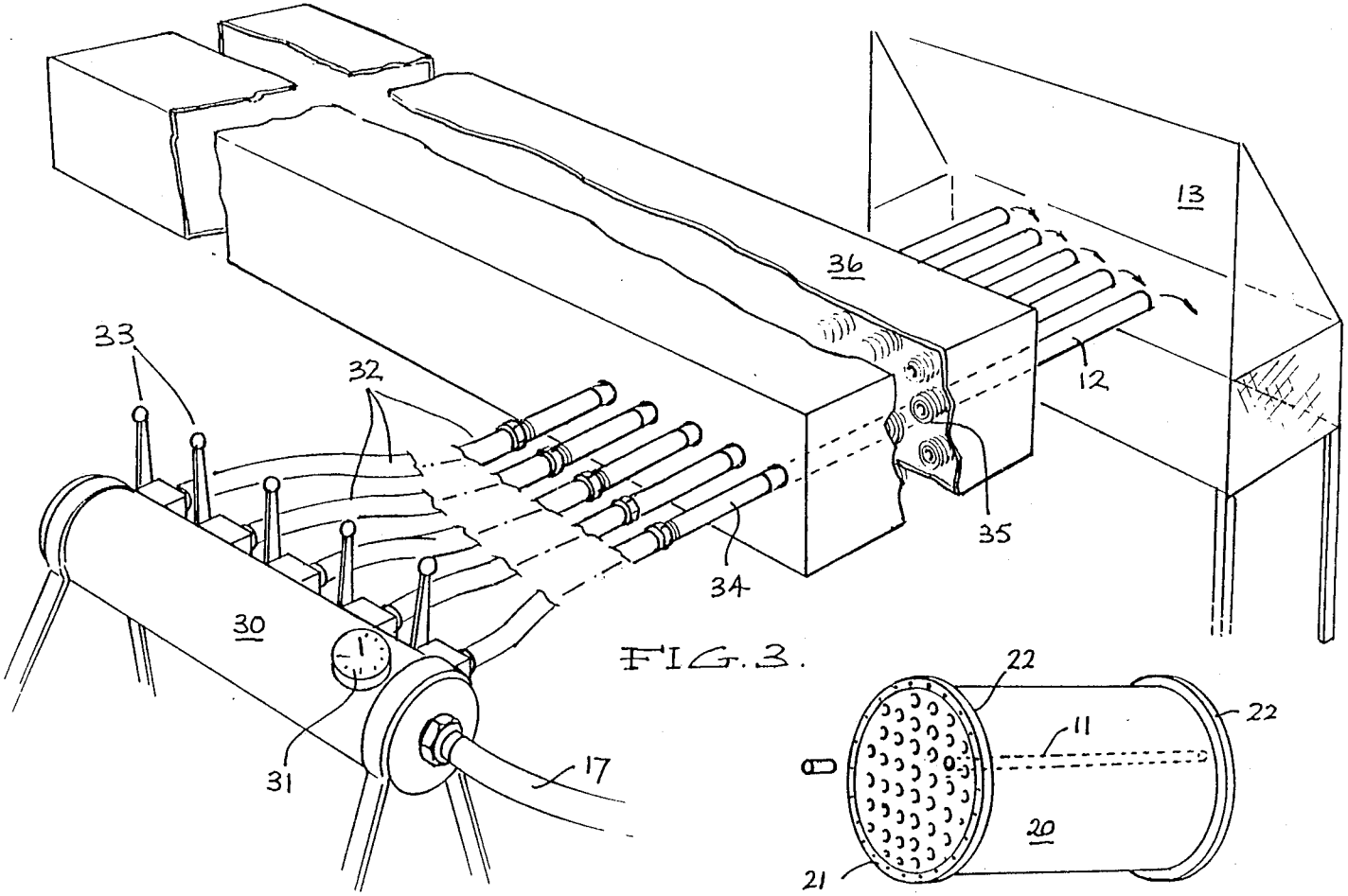
FIG. 2 is a perspective view from one end of a heat exchanger tube bundle, which can be cleaned using the embodiment shown in FIG. 1.
FIG. 3 is another perspective view from one end illustrating an application of the invention to a fin-fan bank.

A bundle of tubes 11 are shown comprising tube bundle 20; see FIG. 2. The ends of the tubes 11 can be seen at end face 21 of tube bundle 20. Flanges 22 are provided at each end of tube bundle 20. A cylindrical pig 23 of "Delrin" is shown in line with the end of one tube 11.

In FIG. 3, flexible connector 19 connects a high pressure pump (not shown) to a manifold 30, having a pressure indicator 31. A series of outlets 32 is shown connected by way of valves 33 to manifold 31. Outlets 32 are connected by way of spacer 34 to launchers (not shown). These launchers abut against the ends of fin-fan tubes 35 forming part of a bank 36. Catchers 32 lead to a cage 13, as in FIG. 1.

Figure 4:
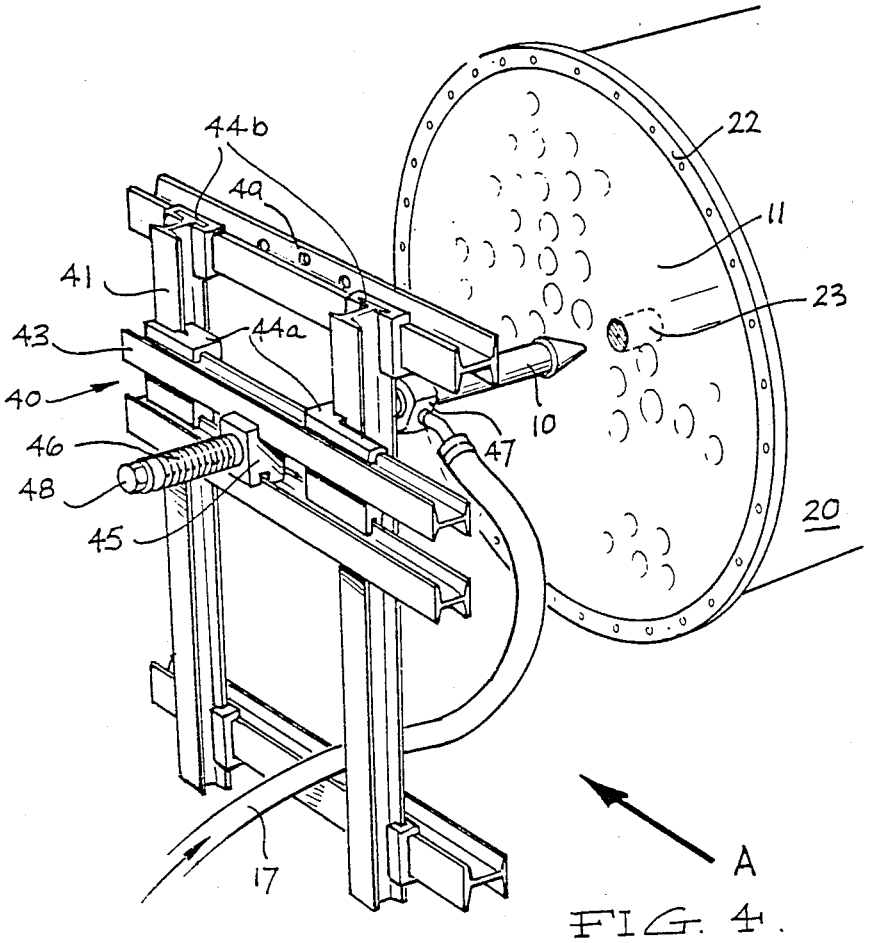
FIG. 4 is another perspective view from one end illustrating the use of an X-Y frame according to the invention.

In FIG. 4, an X-Y frame 40 is shown comprising vertical I-beam components 41 and horizontal I-beam components 42. Movable support means 43 is shown bridging vertical I-beam components 41. Said components 41 and 42 and support means 43 are connected by sliding brackets 44*a* and 44*b*. A thrust block 45 is supported by support means 43. A heavey duty, screw-threaded adjustment means 46 is shown leading to a pressure inlet coupling 47 connecting a launcher 14 to a side-entering flexible connector 17 leading to a valve means (not shown) and a high pressure pump (not shown). Adjustment means 46 may be adjusted by means of a hexagonal nut 48 whereby launcher 10 may be moved axially with respect to the end of a tube 11 in a bundle 20. Holes 49 are provided in horizontal I-beam component 42 whereby the X-Y frame may be bolted to the tube bundle 20 via corresponding holes in flange 22.

Figure 5:
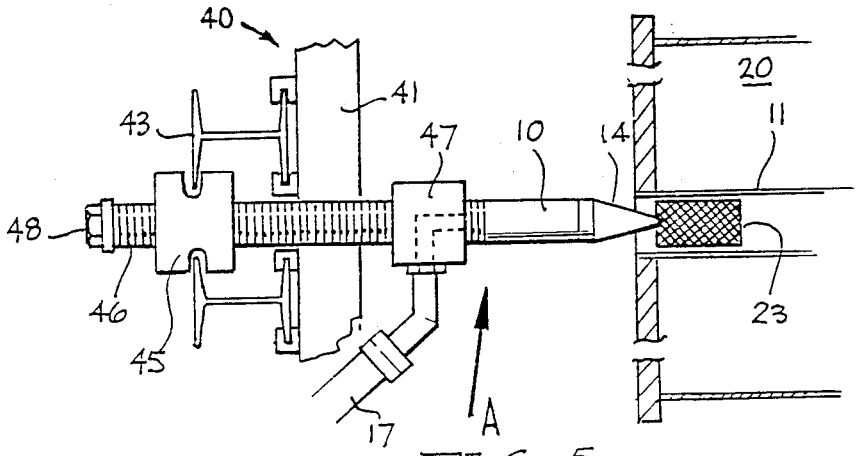
FIG. 5 is a part sectional/part diagrammatic view of the X-Y axis frame embodiment of FIG. 6, taken in direction A shown in FIG. 5.

In FIG. 5, launcher 10 is shown in the launching position for pig 23. High pressure liquid is applied to the pig via inlet coupling 47 and launcher 10.

Figure 6:
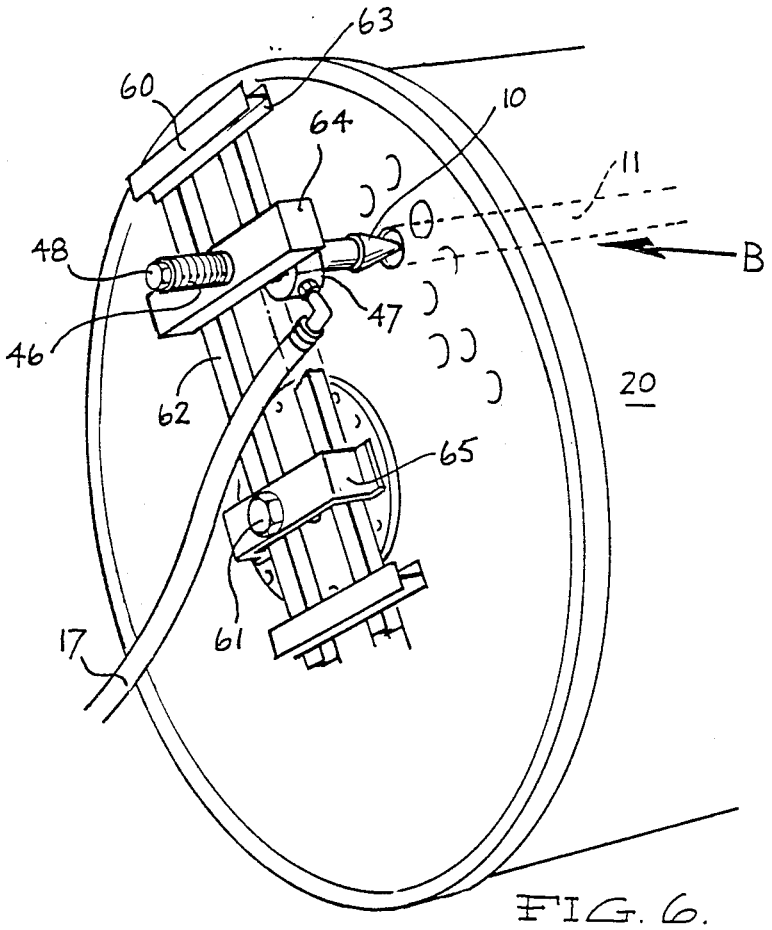
FIG. 6 is a perspective view illustrating the use of a rotary axis adaptor.

In FIG. 6, a rotary axis adaptor 60 is shown as pivoting around a rod (not shown) which penetrates through tube bundle 20. Adaptor 60 comprises two radial I-beam components 62, two I-beam cross-pieces 63, an adjustable thrust block 64 and an adjustable clamp 65, whereby adjustment means 46, and launcher 10, may be moved radially with respect to the axis of the tube bundle and located adjacent a selected tube 11. Numeral 61 indicates a nut whereby adjustable clamp 65 may be tightened upon the aforementioned rod, the adaptor bearing against round spacer plate 66.

Figure 7:
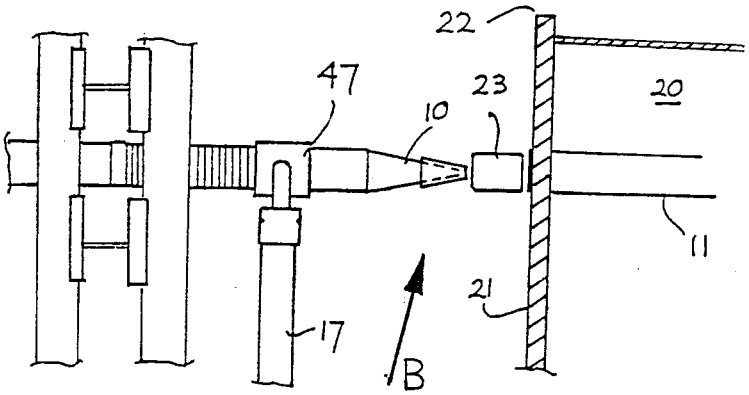
FIG. 7 is a part sectional/part diagrammatic view of the rotary axis adaptor embodiment of FIG. 6, taken in direction B shown in FIG. 6.

In FIG. 7, launcher 10 is shown adjacent a pig 23 and tube 11. This view is similar to that shown in FIG. 5. of FIG. 3, a cylindrical pig of "Delrin" 23 is located at one end of each tube 11 to be cleaned, that is, adjacent end face 21. The pigs may be launched one at a time sequentially or two or more at a time. The pump is started and delivers high pressure liquid such as water to manifold 30. Valves 33 may be opened one at a time or more than one at a time. (The valves are rapid acting, ball valves.) The pig or pigs travel through tube(s) 11, deaccelerate in catcher(s) 12 and fall into cage 13. Launchers 10 are maintained in position with respect to the fin-fan tube stack by any suitable means, for example, by means of a deadweight, by clamping, bolting or using the X-Y frame 40 or rotary axis adaptor 60 just described.

Referring to FIGS. 4 and 5, the use of a flexible connector 17 and the X-Y frame 40 enables launcher 10 to be moved from tube to tube, as desired. The X-Y frame is held in a fixed position with respect to tube bundle 20 by bolting to flange 22, thus withstanding the back pressure when the valve (not shown) is actuated.

It is pointed out that various minor alterations may be made to the abovementioned apparatus without altering the essential invention. For example, thread 15 may be replaced by a bayonet coupling and catcher 12 may be curved not straight. Furthermore, the X-Y frame may be modified to provide movement along the Z axis also, see FIG. 4, and movement may be controlled hydraulically or by means of air pressure.

What is claimed is:

1. Apparatus for cleaning one or more tubes which comprises in combination a source of high pressure liquid and quick-operating valve means connected via a pressure outlet or outlets to one or more launchers for launching pigs, wherein each launcher comprises a high pressure connecting means and a launcher tip, which launcher tip has a frustoconical nozzle section for sealingly engaging the end of a tube to be cleaned, said one or more launchers being mounted upon movable location and support means, which means comprises an X-Y frame for maintaining said one or more launchers in position with respect to the ends of said one or more tubes, whereby said one or more tubes may be cleaned sequentially or simultaneously.

2. Apparatus as claimed in claim 1, wherein said movable location and support means includes means for maintaining said one or more launchers in position and for resisting back pressure when said one or more launchers are being used.

3. Apparatus for cleaning one or more tubes which comprises in combination a source of high pressure liquid and quick-operating valve means connected via a pressure outlet or outlets to one or more launchers for launching pigs, wherein each launcher comprises a high pressure connecting means and a launcher tip, which launcher tip has a frustoconical nozzle section for sealingly engaging the end of a tube to be cleaned, said one or more launchers being mounted upon a rotary axis adapter having radially-movable support means for maintaining said one or more launchers in position with respect to the ends of said one or more tubes, whereby said one or more tubes may be cleaned sequentially or simultaneously.

4. Apparatus as claimed in claim 3 wherein said rotary axis adapter comprises one or more radial support beams in combination with an axial support means and said radially-movable support means for said one or more launchers, which axial support means attaches to a bundle of said tubes and which radially-movable support means maintains said one or more launchers in position and resists back pressure when said one or more launchers are being used.

* * * * *